US008210574B2

(12) United States Patent
Shimaoka et al.

(10) Patent No.: US 8,210,574 B2
(45) Date of Patent: Jul. 3, 2012

(54) REFRIGERANT DISTRIBUTOR

(75) Inventors: Kazuhiro Shimaoka, Ota (JP); Kenichi Nakajima, Ora-gun (JP); Jun Yamauchi, Kumagaya (JP); Shintaro Sugimoto, Ota (JP); Yoshimi Kusama, Ota (JP)

(73) Assignee: Sanyo Electric Co., Ltd., Osaka (JP)

( * ) Notice: Subject to any disclaimer, the term of this patent is extended or adjusted under 35 U.S.C. 154(b) by 131 days.

(21) Appl. No.: 12/781,455

(22) Filed: May 17, 2010

(65) Prior Publication Data

US 2010/0293980 A1 Nov. 25, 2010

(30) Foreign Application Priority Data

May 20, 2009 (JP) ..... 2009-121592

(51) Int. Cl.
*F16L 39/00* (2006.01)

(52) U.S. Cl. ..... 285/319; 285/125.1

(58) Field of Classification Search ..... 285/125.1, 285/131.1, 124.1, 124.5, 321, 93, 319
See application file for complete search history.

(56) References Cited

U.S. PATENT DOCUMENTS

| | | | | | |
|---|---|---|---|---|---|
| 2,082,403 | A * | 6/1937 | Larkin | 138/37 |
| 3,120,743 | A * | 2/1964 | Wilson | 62/504 |
| 3,563,055 | A * | 2/1971 | Owens | 62/525 |
| 3,745,787 | A * | 7/1973 | Ponziani | 62/504 |
| 3,864,938 | A * | 2/1975 | Hayes, Jr. | 62/504 |
| 4,643,222 | A * | 2/1987 | Wiser | 137/528 |
| 5,241,867 | A * | 9/1993 | Cohen et al. | 73/863.41 |
| 5,341,656 | A * | 8/1994 | Rust et al. | 62/324.6 |
| 5,564,754 | A * | 10/1996 | Grenga | 285/125.1 |
| 5,660,418 | A * | 8/1997 | Crawford | 285/125.1 |
| 5,695,225 | A * | 12/1997 | Grenga | 285/125.1 |
| 6,763,673 | B2 * | 7/2004 | Oberley et al. | 62/324.6 |
| 7,174,726 | B2 * | 2/2007 | Grau et al. | 62/115 |

FOREIGN PATENT DOCUMENTS

JP 07-294061 11/1995

* cited by examiner

*Primary Examiner* — Aaron Dunwoody
(74) *Attorney, Agent, or Firm* — McDermott Will & Emery LLP

(57) ABSTRACT

A conical-shaped distributing member 41 is disposed in a refrigerant distributing portion 32 distributing refrigerant, an orifice 34 is disposed by being positioned at an axis 16X of the conical body, the orifice 34 is held by a stop ring 37, and the stop ring 37 urges the orifice 34 in a flow direction of the refrigerant.

3 Claims, 6 Drawing Sheets

REFRIGERANT FLOW DIRECTION DURING HEATING OPERATION

REFRIGERANT DISTRIBUTOR

INCORPORATION BY REFERENCE

The present application claims priority under 35 U.S.C. §119 to Japanese Patent Application No. 2009-121592 filed on May 20, 2009. The content of the applications is incorporated herein by reference in its entirety.

BACKGROUND OF THE INVENTION

1. Field of the Invention

The present invention relates to a refrigerant distributor and particularly to a refrigerant distributor used in an air conditioner in which refrigerant piping of an outdoor heat exchanger is configured with a multiple path.

2. Description of the Related Art

There is known an outdoor heat exchanger functioning as an evaporator in which refrigerant piping is constructed in a multiple path configuration when a multi-type air conditioner in which a plurality of indoor units are connected in parallel with a outdoor unit is configured, in order to improve heat exchange efficiency of the outdoor unit during heating (for example, JP-A-7-294061).

In the above prior-art outdoor heat exchanger, a refrigerant distributor for evenly distributing refrigerant to each path is disposed, and there is known the refrigerant distributor in which an orifice disposed on the upstream of a distributing portion in order to prevent drift in the distributing portion and to improve the effective heat exchange efficiency in each path.

In this case, in order to improve working accuracy of the orifice, it can be considered that the orifice is formed separately from a refrigerant distributor main body and incorporated on the upstream side of the distributing portion.

When this orifice is to be incorporated, it is necessary to fix it at a predetermined position by a predetermined fixing member, but depending on the working accuracy or the like, the incorporated orifice might become loose by a flow of the refrigerant, it is likely that a distribution ratio cannot be kept constant and a noise caused by the looseness is generated.

SUMMARY OF THE INVENTION

Thus, an object of the present invention is to provide a refrigerant distributor that can suppress looseness of a orifice, keep a distribution ratio stably constant and reduce a noise.

In order to achieve the above object, a first mode of the present invention is characterized in that a conical body is disposed in a distributing portion distributing refrigerant, an orifice is disposed by locating it on an axis of the conical body, the orifice is held by a stop ring, and the stop ring urges the orifice in a flow direction of the refrigerant.

According to the above configuration, since the stop ring urges the orifice in the flow direction of the refrigerant, looseness of the orifice while the refrigerant is flowing can be restricted.

A second mode of the present invention is characterized in that an engagement groove portion for holding the stop ring at a predetermined position is provided over the first mode, and the stop ring is deflected in contact with the orifice in a state held by the engagement groove portion.

According to the above configuration, since the stop ring is deflected in contact with the orifice in a state held by the engagement groove, the stop ring can reliably urge the orifice.

According to the present invention, since the stop ring urges the orifice in the refrigerant flow direction, looseness of the orifice is suppressed, the distribution ratio is kept stably constant, and noise can be reduced.

DETAILED DESCRIPTION OF THE PREFERRED EMBODIMENTS

Figure 1:
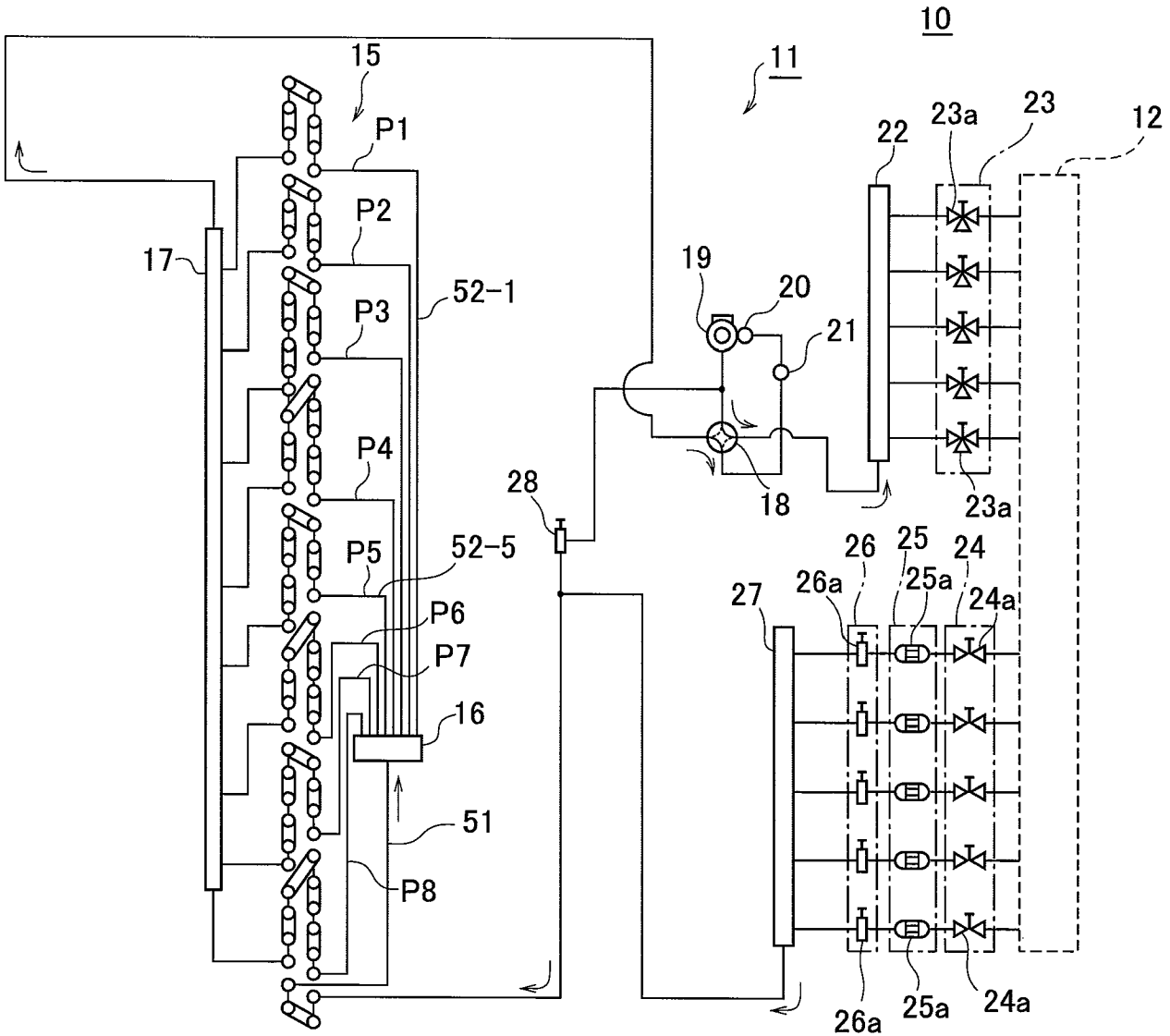
FIG. 1 is a configuration explanatory diagram of a refrigerant circuit of an air conditioning system of the embodiment.

An embodiment of the present invention will be described below referring to the drawings.

FIG. 1 is a configuration explanatory diagram of a refrigerant circuit of an air conditioning system of the embodiment.

The air conditioning system 10 is roughly provided with an outdoor unit 11 and an indoor unit portion 12 provided with a plurality of (five in the embodiment) indoor heat exchangers, not shown.

The outdoor unit 11 includes an outdoor heat exchanger 15 in which refrigerant piping is provided in plural paths (plural systems) P1 to P8, a refrigerant distributor 16 for distributing the refrigerant to each of the paths P1 to P8 of the outdoor heat exchanger 15 during a heating operation, a merging portion 17 where the refrigerant having flown through each of the paths P1 to P8 during the heating operation is merged, a four-way valve 18 for switching refrigerant channels, a compressor 19 for compressing the refrigerant, an accumulator 20 for separating liquid refrigerant and gas refrigerant in a pre-stage of the compressor 19, a sub accumulator 21 for preliminarily separating the liquid refrigerant and the gas refrigerant in a pre-stage of the accumulator 20, and a distributing portion 22 for distributing the refrigerant through a unit pipe to each indoor heat exchanger constituting the indoor unit portion 12 during the heating operation.

Moreover, the outdoor unit 11 includes a first service valve portion 23 provided with a plurality of first service valves 23*a* disposed at each unit pipe, a second service valve portion 24 provided with a plurality of second service valves 24*a* disposed at each unit pipe, a strainer portion 25 provided with a plurality of strainers 25*a* which are disposed at each unit pipe to remove foreign substances and the like in the refrigerant, an expansion valve portion 26 provided with a plurality of expansion valves (mechanical valves) 26*a* disposed at each unit pipe, a merging portion 27 for merging the refrigerant from the indoor unit portion 12 during the heating operation, and a defrosting valve 28 brought into an open state in a defrosting operation of the outdoor heat exchanger 15. During a cooling operation, the merging portion 17 functions as a refrigerant distributing portion, the refrigerant distributor 16 functions as a refrigerant merging portion, the distributing portion 22 functions as a refrigerant merging portion, and the merging portion 27 functions as a refrigerant distributing portion.

Subsequently, a configuration of the refrigerant distributor 16 will be described.

FIG. 2 are appearance diagrams of the refrigerant distributor.

Figure 2A:
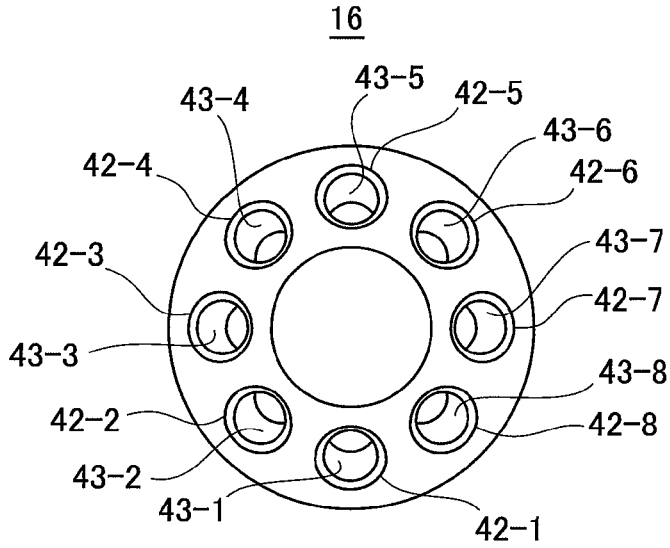
FIG. 2 are appearance diagrams of the refrigerant distributor.
Figure 2B:
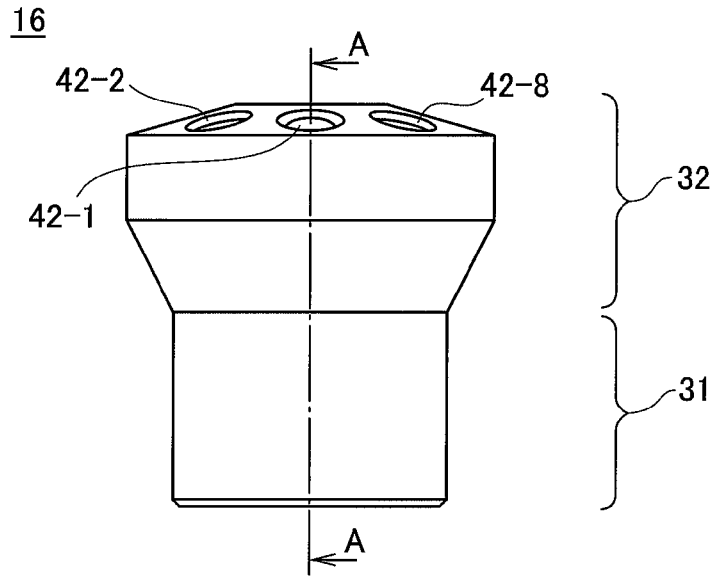
Figure 2C:
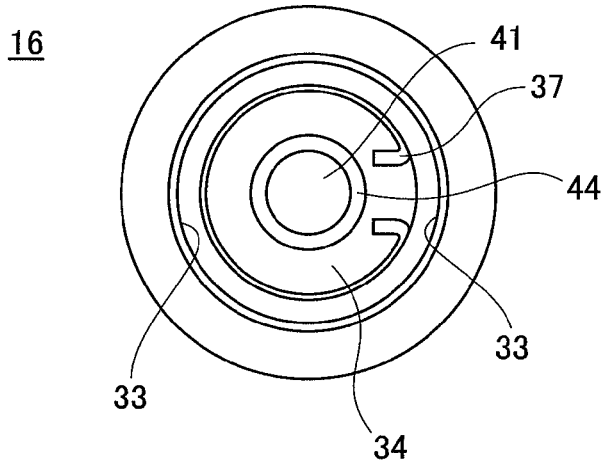

Here, FIG. 2A is a plan view, FIG. 2B is a front view, and FIG. 2C is a bottom view.

Figure 3:
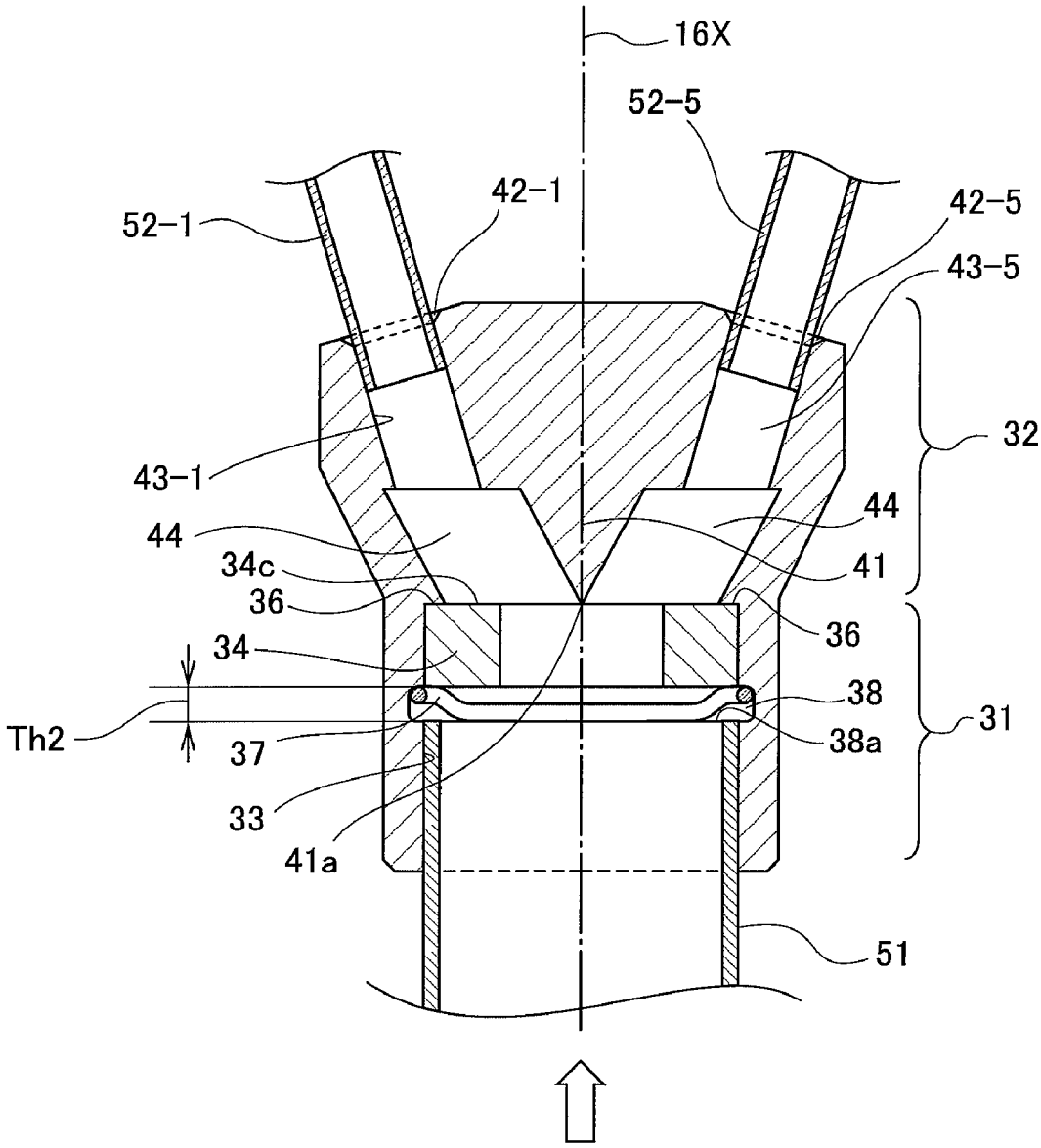
FIG. 3 is an A-A sectional view on arrow of FIG. 2B with external piping connection.

FIG. 3 is an A-A sectional view on arrow of FIG. 2B with external piping connection.

Figure 4:
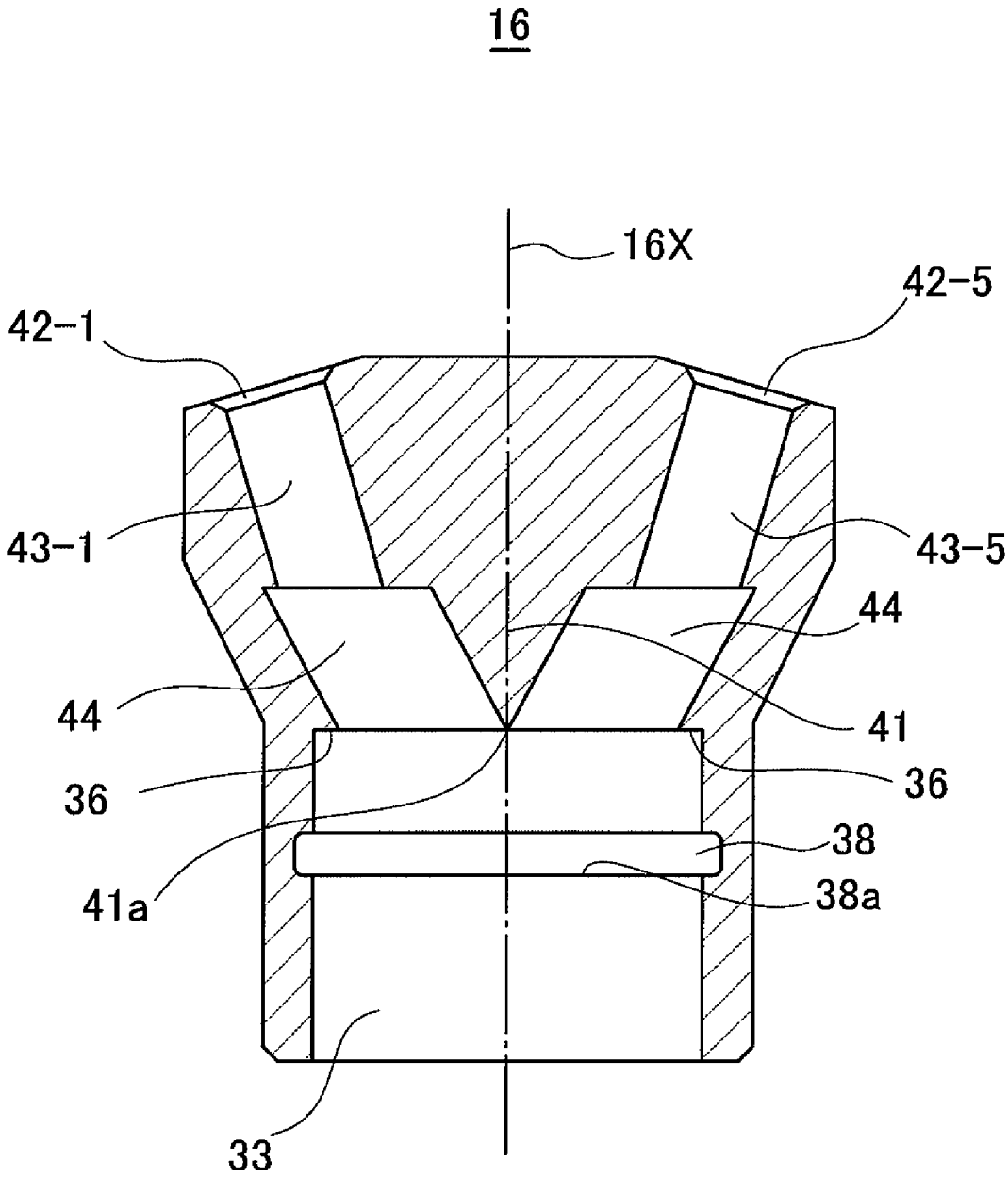
FIG. 4 is an A-A sectional view of a refrigerant distributor main body on arrow in FIG. 2B.

FIG. 4 is an A-A sectional view of a refrigerant distributor main body on arrow in FIG. 2B.

The refrigerant distributor 16 roughly includes a refrigerant introduction portion 31 into which the refrigerant is introduced from the indoor unit portion 12 side during the heating operation and a refrigerant distributing portion 32 for distributing the refrigerant introduced through the refrigerant introduction portion 31 during the heating operation evenly to each of the paths P1 to P8.

The refrigerant introduction portion 31 includes a pipe receiving portion 33 to which an external pipe 51 for introduction of the refrigerant is attached by welding or the like, an orifice 34 for reducing pressure by increasing a refrigerant flow velocity through throttling of a channel diameter, a stop ring (ring-shaped urging member) 37 which urges the orifice 34 in a refrigerant flow direction during heating and presses the same to a orifice receiving portion 36 of a main body portion 35 so as to bring it into a fixed state, and a ring-shaped engagement groove portion 38 in which the stop ring 37 is fitted and held.

The refrigerant distributing portion 32 includes a conical-shaped distributing member 41, communication channels 43-1 to 43-8 disposed on the top face sides of the refrigerant distributor 16 and communicating with holes 42-1 to 42-8 in which external pipes 52-1 to 52-8 for outflow communicating with the paths 21 to P8 of the outdoor heat exchanger 15, respectively, are connected by welding or the like, and a distributing chamber 44 for introducing the refrigerant distributed by the distributing member 41 to the communication channels 43-1 to 43-8 side.

In the above configuration, in order that the refrigerant is distributed evenly, a rotation center axis of the orifice 34 is disposed so that it matches an axis 16X of the conical body constituting the distributing member 41, that is, a flow center of the refrigerant passing through the orifice 34 and flowing substantially matches a top portion 41*a* of the distributing member 41. In addition, a vertical position of the top portion 41*a* is located at a position matching a plane including a top face 34*c* (a face 34*a* or a face 34*b*) of the orifice 34 in FIG. 3.

FIG. 5 are explanatory diagrams of the orifice.

Figure 5A:
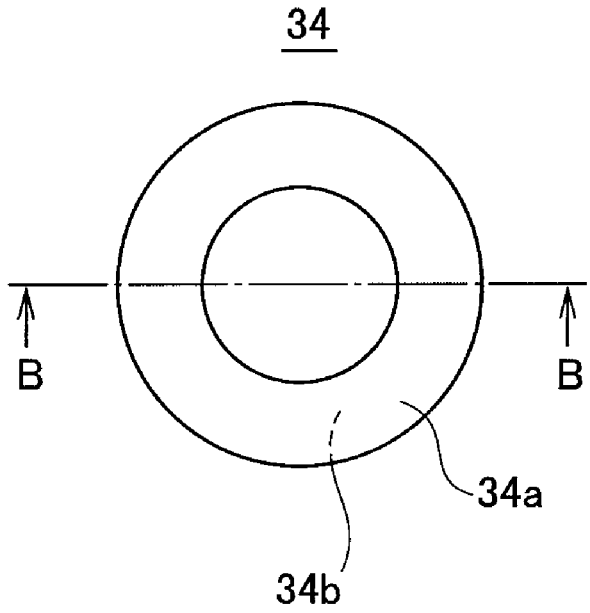
FIG. 5 is an explanatory diagram of an orifice.
Figure 5B:
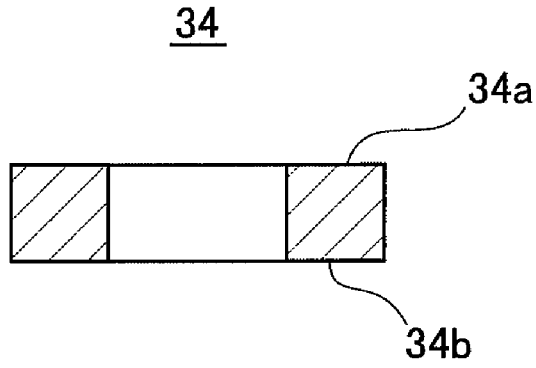

FIG. 5A is a plan view, and FIG. 5B is a B-B sectional view on arrow of FIG. 5A.

The orifice 34 is cylindrical (ring shaped) with the refrigerant flow direction as a height direction, and its face 34*a* and face 34*b* are configured so as to be substantially parallel.

FIG. 6 are explanatory diagrams of the stop ring.

Figure 6A:
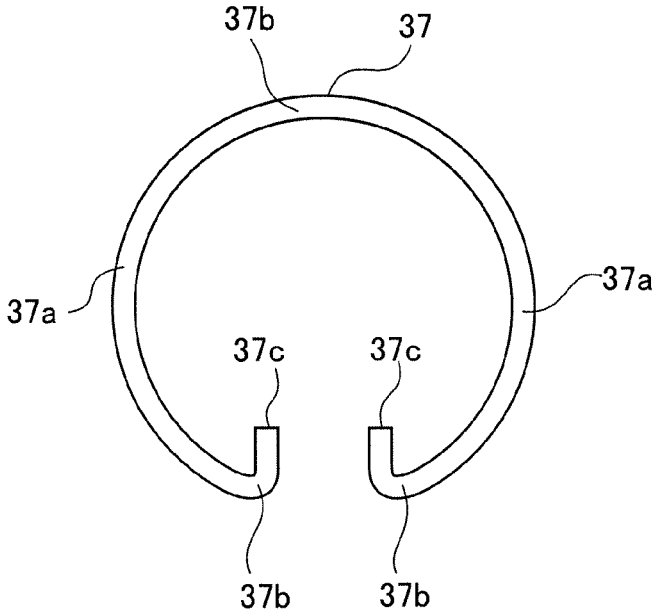
FIG. 6 is an explanatory diagram of a stop ring.
Figure 6C:
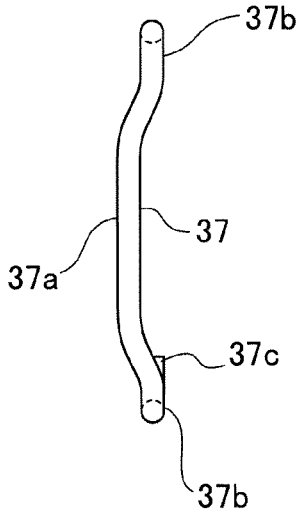
Figure 6B:
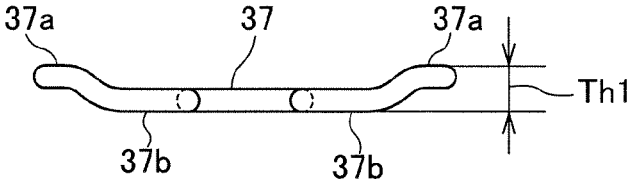

FIG. 6A is a plan view of the stop ring 37, FIG. 6B is a front view, and FIG. 6C is a side view.

The stop ring 37 is configured by a ring-shaped elastic material having a C-shape in a plan view and includes an orifice contact portion 37*a* to be brought into contact with the orifice 34 when the stop ring 37 is fitted in the engagement groove portion 38, a groove contact portion 37*b* to be brought into contact with a contact face 38*a* (See FIG. 4) of the engagement groove portion 38 when the stop ring 37 is fitted in the engagement groove portion 38, and a pair of grasping portions 37*c* for grasping so as to deform and reduce an outer diameter of the stop ring 37 so that they are brought close to each other (approach each other) when the stop ring 37 is fitted in the engagement groove portion 38.

In this case, a thickness Th1 before the stop ring 37 is fitted in the engagement groove portion 38 is larger than a distance Th2 between the contact face 38*a* of the engagement groove portion 38 and a lower face 34*d* (See FIG. 3: the face 34*a* or the face 34*b*) of the orifice 34 when the orifice 34 is pressed onto the orifice receiving portion 36. Therefore, the stop ring 37 is reliably brought into contact with the orifice 34 and in a state fitted in the engagement groove portion 38, the ring is in a deflected state all the time, and the orifice 34 is urged upward in FIG. 3 by elasticity of the ring, elastically pressed onto the orifice receiving portion 36 and reliably brought into a fixed state.

Since the urging direction of the stop ring 37 at this time is along the refrigerant flow direction during heating, if the refrigerant distributor 16 functions as the distributor, it does not become loose by the flow of the refrigerant but can reliably hold the orifice 34 in the fixed state even if the refrigerant is flowing.

Subsequently, an operation of the air conditioning system 10 during the heating operation will be described. In this case, the defrosting valve 28 is supposed to be in the closed state.

As shown in FIG. 1, if the compressor 19 is operated in a state in which the four-way valve 18 is switched to the heating operation side, the refrigerant compressed by the compressor 19 is supplied to the distributing portion 22 through the refrigerant pipe.

As a result, the distributing portion 22 distributes the refrigerant and supplies it to each indoor heat exchanger constituting the indoor unit portion 12 through each of the first service valves 23*a* constituting the first service valve portion 23 and the unit pipe.

As a result, each indoor heat exchanger constituting the indoor unit portion 12 performs heat exchange with air in a room to be heated so as to heat the room to be heated, and the refrigerant goes to the merging portion 27 through the second service valves 24*a* constituting the second service valve portion 24, the strainers 25*a* constituting the strainer portion 25, and the expansion valves 26*a* constituting the expansion valve portion 26.

As a result, the merging portion 27 merges the refrigerant after heating supplied through each of the expansion valves 26*a* and supplies the refrigerant to the refrigerant distributor 16 through the refrigerant pipes including the external pipe 51 for introduction.

The refrigerant introduced into the refrigerant distributor 16 passes through the stop ring 37 and reaches the orifice 34, and the flow velocity is increased by the orifice 34.

At this time, since the center axis of the distributing member 41 is made to match the center axis of the orifice 34, the refrigerant having passed through the orifice 34 flows into the distributing chamber 44 substantially evenly.

That is, since the refrigerant having flown into the distributing chamber 44 flows into the communication channels 43-1 to 43-8 evenly, the refrigerant is made to flow evenly to each of the paths P1 to P8 through the holes 42-1 to 42-8 for outflow.

Also, since the distributing member 41 is formed in a conical shape tapered toward the refrigerant flow direction, if the refrigerant flows smoothly, turbulence is hardly generated and the flow is not disturbed, distribution can be made even, and also, generation of a noise in distribution can be suppressed, and noise can be reduced. Since the stop ring 37 is reliably brought into contact with the orifice 34 and in the deflected state all the time while being fitted in the engagement groove portion 38, looseness can be suppressed even during the cooling operation, and thus, noise can be reduced.

Moreover, since an urging direction of the stop ring 37 to the orifice 34 is along the refrigerant flow direction during heating, the orifice 34 does not become loose by the refrigerant flow, the orifice 34 can be reliably maintained in the fixed state even if the refrigerant is flowing, the refrigerant flow is not disturbed by the looseness, and the refrigerant can be distributed evenly. Moreover, generation of a noise caused by the looseness of the orifice 34 can be also restricted.

Then, the refrigerant made to flow evenly to each of the paths P1 to P8 by the refrigerant distributor 16 reaches the merging portion 17, is merged in the merging portion 17 and then, separated to gas and liquid by the sub accumulator 21 and the accumulator 20, reaches the compressor 19 again and is compressed again.

As described above, according to this embodiment, since the stop ring 37 urges the orifice 34 in the refrigerant flow direction in the refrigerant distributor 16, looseness of the orifice 34 can be suppressed in a state in which the refrigerant is flowing, the refrigerant can be distributed to each of the paths P1 to P8 of the outdoor heat exchanger 15 with a constant distribution ratio all the time, and favorable refrigerant distribution performance and hence, favorable heating performance can be realized. By suppressing the looseness of the orifice 34, a noise caused by the looseness can be also restricted.

In the above description, the case in which the number of paths in the outdoor heat exchanger 15 is 8 was described, but application is possible as long as there are multiple paths.

What is claimed is:

1. A refrigerant distributor comprising:

a conical body disposed in a distributing portion distributing refrigerant;

an orifice positioned in an axis of the conical body;

a stop ring for holding the orifice and urging the orifice in a flow direction of the refrigerant; and an engagement groove portion for holding the stop ring at a predetermined position, wherein:

the stop ring is made of an elastic material and has a thickness such that before the stop ring fits in the engagement groove portion, the thickness is greater than a distance between the engagement groove portion and the orifice when the orifice is held in the conical body, and the stop ring is elastically deflected in contact with the orifice held by the engagement groove portion and urges the orifice in a flow direction of the refrigerant.

2. The refrigerant distributor according to claim 1, further comprising a pipe receiving portion to which an external pipe for introduction of the refrigerant is attached, wherein the stop ring is disposed between the orifice and the pipe receiving portion.

3. The refrigerant distributor according to claim 1, wherein:

the stop ring has a C-shape in a plan view and includes an orifice contact portion to be brought into contact with the orifice when the stop ring is fitted in the engagement groove portion, a groove contact portion to be brought into contact with the engagement groove portion when the stop ring is fitted in the engagement groove portion, and the stop ring includes a pair of grasping portions that are deformed so as to approach each other when the stop ring is fitted in the engagement groove portion.

* * * * *